US005383656A

United States Patent [19]

Mandel et al.

[11] Patent Number: 5,383,656

[45] Date of Patent: Jan. 24, 1995

[54] SINGLE DRIVE NIP SHEET BUFFERING SYSTEM USING INDEPENDENTLY DRIVEN ROLLS WITH DIFFERENT FRICTIONAL PROPERTIES

[75] Inventors: Barry P. Mandel, Fairport; David R. Kamprath, Webster, both of N.Y.; Francesca A. Barrientos, Berkeley, Calif.; Richard A. Van Dongen, Newark, N.Y.; Anthony T. DeSanctis, Webster, N.Y.; Charles D. Rizzolo, Rochester, N.Y.

[73] Assignee: Xerox Corporation, Stamford, Conn.

[21] Appl. No.: 25,475

[22] Filed: Mar. 3, 1993

[51] Int. Cl.[6] ..... B65H 7/14

[52] U.S. Cl. ..... 271/258; 271/177; 271/182; 271/237; 271/242

[58] Field of Search ..... 271/121–125, 271/237, 258, 259, 265, 177, 182, 183, 242

[56] References Cited

U.S. PATENT DOCUMENTS

| | | | |
|---|---|---|---|
| 2,979,330 | 4/1961 | Weber | 271/114 |
| 4,270,743 | 6/1981 | Crampton | 271/182 X |
| 4,285,513 | 8/1981 | Kwasnitza | 271/183 X |
| 4,693,461 | 9/1987 | Takahashi | 271/182 X |
| 4,801,134 | 1/1989 | Yokoyama | 271/122 |
| 5,008,713 | 4/1991 | Ozawa | 271/121 X |
| 5,137,265 | 9/1992 | Masaaki Sato, et al. | 270/53 |
| 5,083,761 | 8/1989 | Akiyoshi Johdai, et al. | 271/3.1 |

*Primary Examiner*—Richard A. Schacher

*Attorney, Agent, or Firm*—Fay, Sharpe, Beall, Fagan, Minnich & McKee

[57] ABSTRACT

A paper transport system includes an apparatus for controlling movement of the sheets along the predetermined course to provide sheet buffering. The apparatus includes first and second friction surfaces mounted for movement in orbital paths on opposite sides of the predetermined course in opposed relationship to define a nip through which the paper sheets pass. A selectively operable drive is provided for independently controlling the movement of the first and second friction surfaces, and the first friction surface has a coefficient of friction with the paper sheets which is greater than the coefficient of friction of the second surface with the paper sheets which is in turn greater than the coefficient of friction between the paper sheets.

48 Claims, 3 Drawing Sheets

SINGLE DRIVE NIP SHEET BUFFERING SYSTEM USING INDEPENDENTLY DRIVEN ROLLS WITH DIFFERENT FRICTIONAL PROPERTIES

BACKGROUND OF THE INVENTION

Cross-reference and citation is made to two copending applications addressing some of the same problems and technology by the same assignee: U.S. application Ser. No. 08/057,941, filed May 7, 1993 by Richard S. Smith, entitled "Print Skip Avoidance for On-Line Compiling", and U.S. application Ser. No. 08/065,099, filed May 19, 1993, by Barry P. Mandel, et al., entitled "Trail Edge Buckling Sheet Buffering System".

The subject invention is directed to the art of paper sheet handling and, more particularly, to a sheet buffering system.

The invention is especially suited for use in the paper handling and transport system of an electrophotographic printing machine and will be described with reference thereto; however, as will become apparent, the invention could be used in many types of paper sheet handling systems in a variety of different machines.

In electrophotographic printing machines, it is sometimes necessary or desirable to temporarily hold or delay the transport of individual paper sheets at various times in the processor to provide additional time for downstream processing to be performed. Such temporary holding or delaying of sheets is generally referred to as "buffering" and has been accomplished in many different ways.

One prior art method of buffering has been to temporarily slow or stop a roll nip or other paper transport for a period of time equal to the inter-copy-gap between successive sheets. Of course, this yields only a very short buffering time. If longer times are required, other systems must be used. For example, multiple path systems and systems which run sheets against stalled roll pairs or stop gates have sometimes been used.

BRIEF SUMMARY OF THE INVENTION

The subject invention provides a simple and effective buffering system which uses only one paper path and maintains positive drive on the sheets at all times.

Generally, the subject invention comprises a paper transport system wherein paper sheets are moved seriatim along a predetermined course with the system including an improved apparatus for controlling movement of the sheets along the course. The improved apparatus comprises first and second friction surfaces mounted for movement in orbital paths on opposite sides of the predetermined course in opposed relationship to define a nip through which the sheets must pass. Selectively operable drive means are provided for independently controlling the movement of the first and second friction surfaces. The first friction surface has a coefficient of friction with the paper sheets which is greater than the coefficient of friction of the second surface with the paper sheets which is, in turn, greater than the coefficient of friction between the paper sheets.

Because of the noted relationship between the coefficients of friction of the first and second friction surfaces, the apparatus allows two sheets to be stopped and held in the same nip and then fed out either independently or simultaneously. Note that when a first sheet is in the nip, the first friction surface can be stopped while the second friction surface continues to be driven. The first sheet will, however, be stopped and frictionally held by the first friction surface. A second sheet can then be fed between the stopped first sheet and the second friction surface. By then stopping movement of the second friction surface, both the first and second sheets are held in the nip. Alternatively, by selectively driving both or a selected one of the friction surfaces, both or a selected one of the sheets can be driven from between the nip.

In accordance with a further aspect of the invention, there is provided a method of controlling the movement of paper sheets in a sheet transport system wherein the sheets are moved seriatim along a predetermined course of movement. The method comprises providing along the predetermined course of movement a nip through which the paper sheets are passed, with the nip being defined by opposed first and second friction surfaces mounted for movement in orbital paths. The first friction surface is selected to have a coefficient of friction with the paper sheets which is significantly greater than the coefficient of friction of the second friction surface with the paper sheets which is, in turn, selected to be significantly greater than the coefficient of friction of the paper sheets with each other. The method further comprises driving the first and second friction surfaces in their orbital paths to cause the nip to impel sheets therethrough, and when it is desired to stop a first sheet traveling through the nip, stopping orbital movement of the first friction surface and maintaining it stopped at least until a second sheet enters the nip.

BRIEF DESCRIPTION OF THE DRAWINGS

For a better understanding of the invention as well as other objects and further features thereof, reference is made to the following drawing and descriptions.

DETAILED DESCRIPTION OF THE PREFERRED EMBODIMENTS

While the present invention will be described hereinafter in connection with the preferred embodiment thereof, it will be understood that it is not intended to limit the invention to that embodiment or embodiments. On the contrary, it is intended to cover all alternatives, modifications, and equivalents as may be included in the spirit and scope of the invention as defined by the appended claims.

Figure 1:
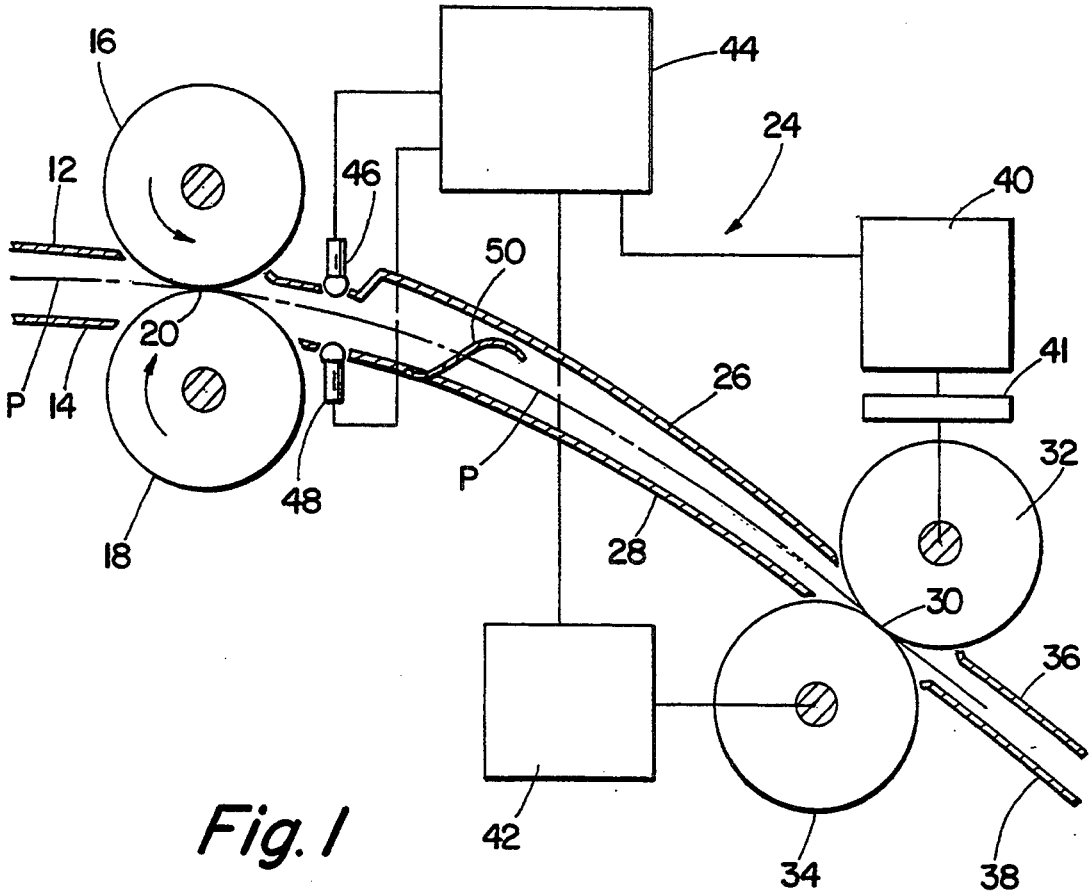
FIG. 1 is a schematic elevational view of a portion of a paper transport system incorporating the invention.
Figure 2:
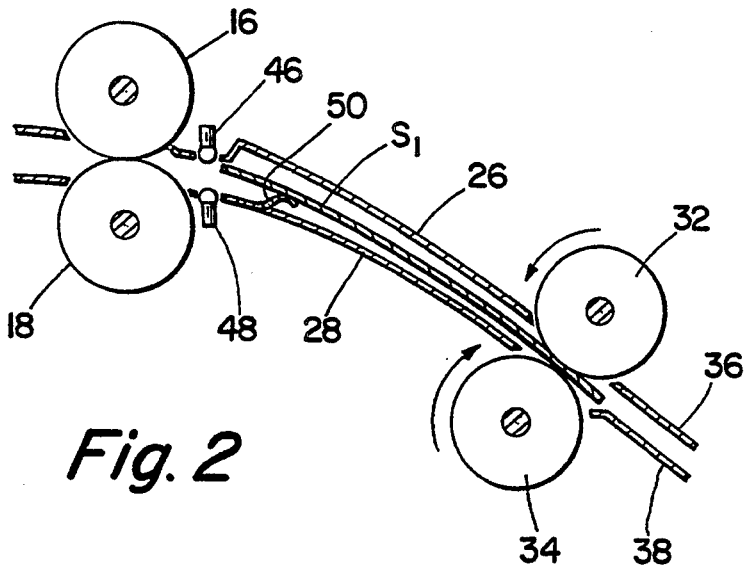
FIGS. 2 through 5 are partial schematic elevational views similar to FIG. 1 but showing a possible sequence of steps in using the apparatus of FIG. 1.

For a general understanding of the features of the invention, the preferred embodiment is shown in FIG. 1 of the drawings. In the drawings, like reference numerals have been used throughout to designate identical elements. FIG. 1 schematically depicts a portion of a sheet transport system having a sheet buffering arrangement according to the invention incorporated therein. The system shown in FIG. 1 is specifically intended for use in an electrophotographic printing machine; however, the apparatus and system could clearly be used in a variety of other types of equipment incorporating sheet handling and transportation systems. Broadly, as illustrated in FIG. 1, the apparatus generally comprises guide means which define a predetermined course of paper movement or path indicated generally by the dash dot line P. In the preferred embodiment, the guide means comprise a spaced pairs of respective upper and lower guide panels 12 and 14, respectively, which direct sheets to a first pair of horizontally positioned driven rolls 16 and 18, respectively. The rolls 16 and 18 are positioned in opposed relationship and driven in the direction of the arrows to define a first drive nip 20.

The buffering station 24 is located immediately downstream of the drive rolls 16, 18 and includes upper and lower sheet guides 26 and 28 which are positioned in spaced opposed relationship and arranged to direct sheets coming from the drive nip 20 downwardly into the nip 30 of a second pair of spaced rolls 32 and 34, respectively.

Sheets passing through the nip 30 are received and directed along the predetermined path of paper movement to subsequent use or processing equipment (not shown) by suitable guide means in the form of guide plates or panels 36 and 38.

For reasons which will subsequently become apparent, the rolls 32 and 34 are each provided with separate drive means capable of independent operation. Also, roll 32 is equipped with a braking means. In the FIG. 1 showing, the drive means are depicted schematically and could comprise any standard type of drive motor. As illustrated, roll 32 is provided with a first independent drive means 40 and a brake 41. Roll 34 is driven in a similar manner from an independent drive means 42. The drive means 40 and 42 are controlled in a manner subsequently to be described from a main controller unit 44. Suitable sheet sensors 46 and 48 are positioned immediately downstream of the rolls 16 and 18 to detect the presence of sheets entering the buffering station 24.

The system and apparatus shown in FIG.1 allows two sheets to be stopped in the buffer station 24 and held in nip 30 and then fed out either independently or at the same time. While this function is being carried out, the system maintains a positive drive on the sheets at all times. To accomplish this function and result, the system is arranged so that the rolls 32 and 34 have a particular relationship in their coefficient of friction relative to the paper being handled. Specifically, the roll 32 is a high friction roll and has a coefficient of friction relative to the paper being transferred which is higher than the coefficient of friction of roll 34 relative to the paper being transferred, and both rolls have their coefficient of friction selected so that they are higher than the coefficient of friction of the paper to paper.

Although many different materials could be used to form the rolls 32 and 34 to have the required relative coefficient of friction. In the subject embodiment, the low friction roll 34 is made of microcellular urethane with a coefficient of friction to paper of approximately 1.2, and the high friction roll 32 has a surface coating of an RTV silicone with a coefficient of friction to paper of approximately 2.5. The soft, compressible nature of the microcellular urethane yields a wide nip zone. This distributes the nip force over a large area resulting in low pressures that minimize the forces that can cause image smear.

With the rolls 32 and 34 having the relative coefficient of friction in the ranges as described, the system can be operated generally in the manner best understood by reference to FIGS. 2 through 5. For example, as shown therein, a first paper sheet is driven into the buffering nip 30 by being directed thereto from rolls 16 and 18. At the time the sheet S is directed to the buffering nip 30, both rolls 32 and 34 are being driven from their respective drive means 40, 42. As the trailing edge of the sheet S passes the sensors 46, 48, the controller 44 acts to stop the driving movement of roll 32 (the roller having the highest coefficient friction relative to the paper). Also, brake 41 is simultaneously actuated to hold roll 32 in its stopped position. Roll 34 continues to be driven but the sheet S remains stationary in the position shown in FIG. 3 because of the significantly higher coefficient of friction between the sheet and the stopped roll 32. Of course, the driven roll 34 merely continues rotating and slips on the surface of sheet S.

Figure 3:
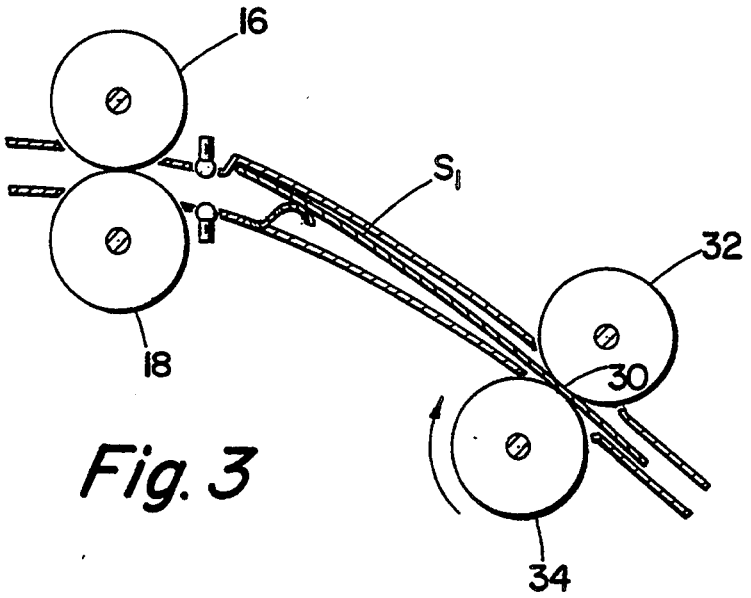
Figure 4:
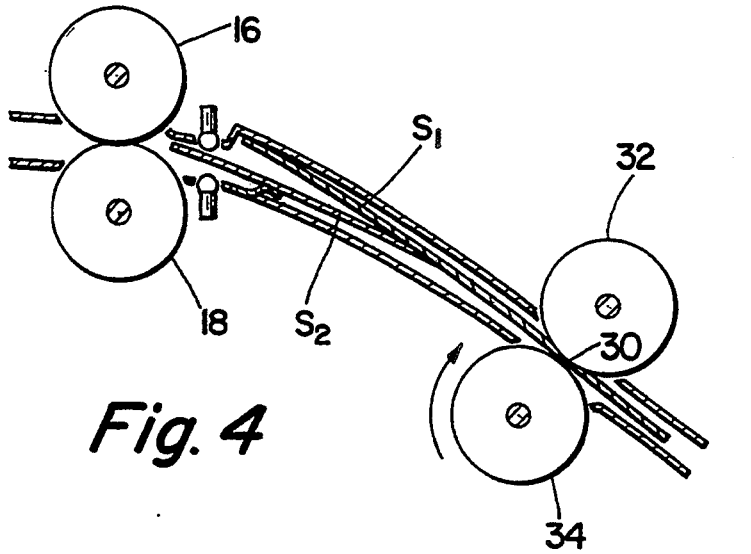
Figure 5:
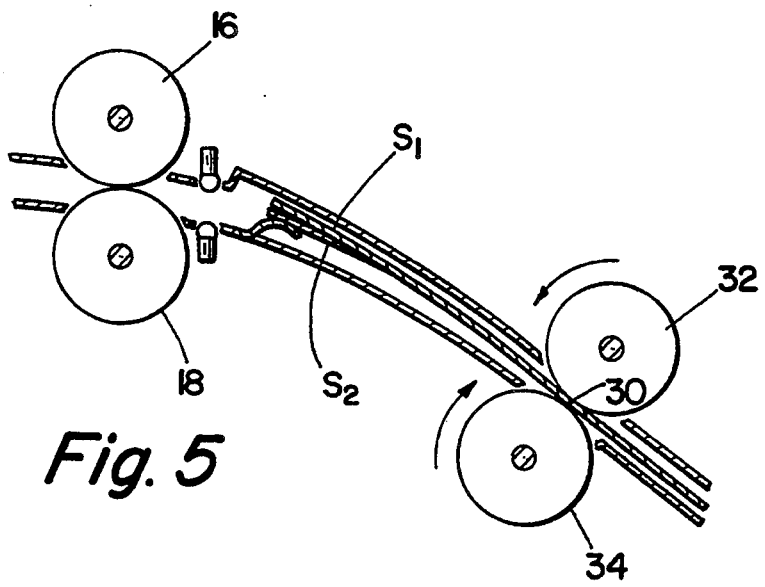

It should be noted as shown in FIG. 3 that when the sheet S has moved to the stopped position, the trailing edge is preferably in an upper or raised position as permitted by the shape of upper guide plate 26 and the action of a Mylar leaf spring 50. This places the first sheet $S_1$ in a position such that the second sheet to enter the buffering station 24 from rolls 16, 18 will enter a position beneath sheet $S_1$. This is shown in FIG. 4 wherein the second sheet $S_2$ is engaged between the driven roller 34 and the first sheet $S_1$. Because of the relationships between the various coefficient of friction, the sheet $S_2$ is driven along the path and slides along on the first sheet $S_1$ which maintains its stationary position against the stopped roll 32. With the second sheet $S_2$ fed into the nip 30, both rolls can be actuated to drive both sheets $S_1$ and $S_2$ out of the buffering station simultaneously. Alternatively, it is, of course, possible to maintain roll 32 in its stopped position and merely drive the second sheet $S_2$ through nip 30 while maintaining sheet $S_1$ in its stopped position. Of course, it is also possible to stop roll 32 for a predetermined period of time to hold both sheets $S_1$ and $S_2$ in position in nip 30. Thereafter, the rolls 32, 34 can be actuated to drive either or both of sheets $S_1$ and $S_2$ from the nip 30.

Figure 6:
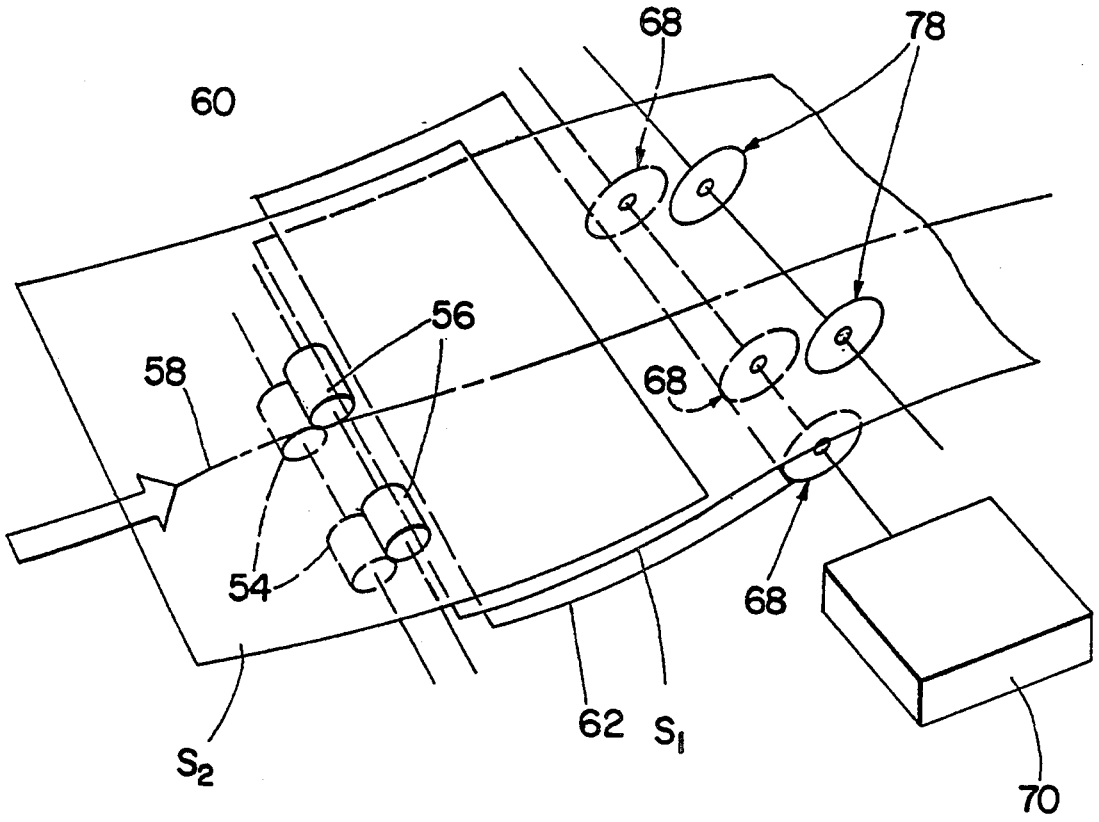
FIG. 6 is a schematic showing of a modified form of sheet buffering system; and, FIG. 7 is a side elevational view of the FIG. 6 embodiment.
Figure 7:
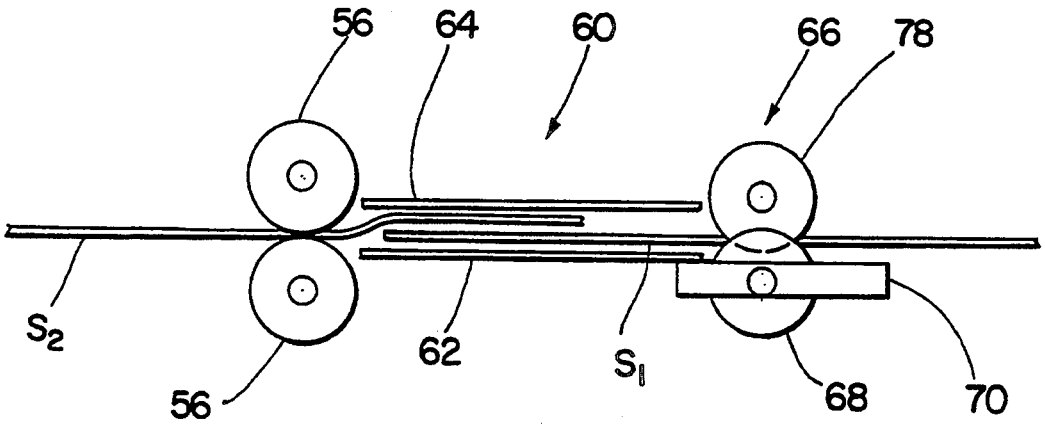

FIGS. 6 and 7 show an alternate embodiment wherein a single set of drive rolls in combination with superposed idler rolls can hold a first sheet while a second sheet is driven into the nip between the driven and idler rolls. More particularly, as illustrated, the FIG. 6 embodiment includes a first set of opposed rolls 54 and 56 which define a feed nip and are driven in the direction shown to feed paper sheets $S_1$ and $S_2$ along the path 58 to a buffering station 60.

The buffering station 60 includes support and guide baffles 62 and 64 which confine the sheets moving along path 58 and direct them into the corrugation roll arrangement 66. The corrugation roll arrangement 66 comprises a lower set of rolls 68 that are driven from a suitable drive 70. A superjacent set of idler rolls 78 are positioned so that individual ones of the idler rolls 78 are axially intermediate the drive rolls 68 and slightly interleaved therewith to cause the sheets S therebetween to be corrugated and gripped.

In operation of the FIGS. 6 and 7 embodiment, the first sheet $S_1$ to enter the buffering station 60 is stopped at the location shown by stopping the corrugation drive rolls 68. These rolls have the high coefficient of friction and preferably have the construction as described relative to rolls 34 of the FIGS. 1–5 embodiment. The first sheet $S_1$ is thus held in the position shown, as the second sheet $S_2$ enters the buffering station.

With sheet $S_1$ held in position, second sheet $S_2$ is driven into the corrugation nip between sheet $S_1$ and the idler rolls 78. When the second sheet $S_2$ is substantially even with sheet $S_1$, the controller actuates the drive rolls. Both sheets $S_1$ and $S_2$ are then driven through the corrugation nip since sheet $S_2$ is loaded against sheet $S_1$ by the idler rolls 78. This generates a positive drive force on the sheets yet little drag force.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. In a paper transport system wherein paper sheets are moved seriatim along a predetermined course, an improved apparatus for controlling movement of the sheets along the predetermined course comprising:

first and second friction surfaces, the first and second friction surfaces being mounted for movement in orbital paths on opposite sides of the predetermined course in opposed relationship to define a nip through which the paper sheets pass, the first friction surface having a coefficient of friction with the paper sheets which is greater than the coefficient of friction of the second surface with the paper sheets which is in turn greater than the coefficient of friction between the paper sheets; and, selectively operable drive means for independently controlling the movement of the first and second friction surfaces, the drive means including means for stopping movement of said first friction surface while moving said second friction surface to buffer a first copy sheet at said nip while impelling a second copy sheet into said nip.

2. A paper transport system as defined in claim 1 wherein at least one of the first and second friction surfaces is carried on a cylindrical member mounted to rotate about its longitudinal axis.

3. A paper transport system as defined in claim 1 wherein at least one of the first and second friction surfaces is on an endless flexible belt.

4. A paper transport system as defined in claim 1 wherein each of the first and second friction surfaces is continuous throughout its respective orbital path.

5. A paper transport system as defined in claim 1 wherein each of the first and second friction surfaces has substantially constant friction characteristics throughout its full extent.

6. A paper transport system as defined in claim 1 wherein the drive means is capable of selectively stopping and reversing the direction of movement of the first and second friction surfaces about their respective paths of orbital movement.

7. The apparatus according to claim 1 wherein the first and second friction surfaces are carried by roll members which are interleaved to cause the paper sheets passing therethrough to be corrugated.

8. A method of controlling the movement of paper sheets in a sheet transport system wherein the sheets are moved seriatim along a predetermined course of movement comprising the steps of:

a) providing along the predetermined course of movement a nip through which the paper sheets are passed;

b) defining the said nip with opposed first and second friction surfaces mounted for movement in orbital paths with the first friction surface having a coefficient of friction with the paper sheets which is significantly greater than the coefficient of friction of the second friction surface with the paper sheets which is in turn significantly greater than the coefficient of friction of the paper sheets with each other;

c) driving the first and second friction surfaces in their orbital paths to cause the nip created thereby to impel sheets therethrough; and, d) when it is desired to stop a first sheet travelling through the nip, stopping orbital movement of only the first friction surface and maintaining it stopped at least until a second sheet enters the nip.

9. A method as defined in claim 8 including the step of directing the second sheet into the nip to a location between the first sheet and the second friction surface.

10. A method as defined in claim 8 including the step of restarting orbital movement of the first friction surface after the second sheet is in the nip.

11. A method as defined in claim 10 including continuing movement of the second friction in its orbital path after the orbital movement of the first frictional surface is restarted.

12. A paper sheet buffering apparatus for use in a paper transport system, the buffering apparatus comprising:

sheet guide means associated with the paper transport system for coextensively guiding first and second copy sheets having a first coefficient of friction therebetween along a copy sheet path;

first movable friction surface means movable along an orbital path on a first side of the sheet guide means and having a second coefficient of friction with said copy sheets which is greater than said first coefficient of fiction for selectively impelling said first copy sheet along said copy sheet path;

second movable fiction surface means positioned in opposing relationship with said first fiction surface means at the sheet guide means, movable along an orbital path and having a third coefficient of friction with said copy sheets which is greater than said first coefficient of friction and less than said second coefficient of friction, for selectively impelling said second copy sheet along said copy sheet path; and, selectively operable drive means for independently controlling the movement of the first and second fiction surface means, the drive means including means for stopping movement of said first movable fiction surface means while moving said second movable friction surfaces means to buffer the first copy sheet at said guide means while impelling said second copy sheet into said guide means.

13. The apparatus according to claim 12 wherein said selectively operable drive means includes means, while said first and second copy sheets are at said guide means, for stopping movement of said second movable friction surface means while moving said first movable friction surface means to in turn first propel said first copy sheet from said guide means then propel said second copy sheet from the guide means wherein the leading edge of said second copy sheet is in substantial abutment with the trailing edge of said the first copy sheet.

14. The apparatus according to claim 12 wherein said selectively operable drive means includes means, while said first and second copy sheets are at said guide means, for operating both said first and second movable friction surface means to simultaneously propel both said first and second copy sheets from said guide means coextensively.

15. In a paper transport system wherein paper sheets are moved seriatim along a predetermined course, an improved apparatus for controlling movement of the sheets along the predetermined course comprising first and second fiction surfaces mounted for movement in orbital paths on opposite sides of the predetermined course in opposed relationship to define a nip through which the paper sheets pass, selectively operable drive means for controlling the movement of the first friction surface, the drive means including means for stopping movement of said first friction surface to hold a first sheet at said nip while said second friction surface moves receiving a second sheet at said nip between said first sheet and said second friction surface, the first fiction surface having a coefficient of friction with the paper sheets which is greater than the coefficient of fiction of the second surface with the paper sheets which is in turn greater than the coefficient of fiction between the paper sheets.

16. The apparatus according to claim 15 wherein there are guide baffle means for guiding the paper sheets into the nip between the first and second friction surfaces, said baffle means including an offset portion for receiving a first sheet and permitting a second sheet to enter the nip without stubbing on the first sheet.

17. The apparatus according to claim, 15 wherein the first and second friction surfaces are carried by roll members which are interleaved to cause the paper sheets passing therethrough to be corrugated.

18. A method of controlling the movement of paper sheets in a sheet buffering apparatus wherein the sheets are moved seriatim along a predetermined course of movement, the method comprising the steps of:

a) providing along the predetermined course of movement a trailing edge buckling member through which the paper sheets are passed;

b) providing a nip along the predetermined course of movement downstream of said trailing edge buckling member;

c) defining the said nip with a first fiction surface and an opposed second fiction surface, at least the first friction surface being mounted for movement in an orbital path;

d) urging a first sheet to travel against said trailing edge buckling member;

e) driving the first friction surface in its orbital path to cause the nip created thereby to receive the first sheet therein; and, f) when it is desired to stop the first sheet at the nip i) stopping orbital movement of the first friction surface engaging a lead portion of the first sheet; and, ii) engaging a trailing portion of the first sheet with said trailing edge buckling member urging said trailing portion out of said predetermined course of movement.

19. The method of controlling the movement of paper sheets in a sheet buffering apparatus according to claim 18 further including the step of urging a second sheet to travel against said trailing edge buckling member and toward said first nip while maintaining orbital movement of the first friction surface engaging said lead portion of the first sheet stopped.

20. The method of controlling the movement of paper sheets in a sheet buffering apparatus according to claim 19 further including the step of urging a second sheet to travel against said trailing edge buckling member while simultaneously driving the first friction surface in its orbital path causing the nip created thereby eject the first sheet from the sheet buffering apparatus.

21. The method of controlling the movement of paper sheets in a sheet buffering apparatus according to claim 19 wherein the step of urging the second sheet to travel toward said first nip against said trailing edge buckling member includes the step of receiving said second sheet between said first sheet and said second friction surface.

22. The method of controlling the movement of paper sheets in a sheet buffering apparatus according to claim 21 further comprising the step of engaging a trailing portion of the second sheet with said trailing edge buckling member urging said trailing portion of the second sheet out of said predetermined course of movement.

23. A paper sheet buffering apparatus for use in a paper transport system, the buffering apparatus comprising:

sheet guide means associated with the paper transport system for coextensively guiding first and second copy sheets having a first coefficient of friction therebetween along a copy sheet path;

baffle means in said sheet guide means for receiving a trailing edge of said first sheet therein;

urging means for urging said trailing edge of said first sheet into said baffle means;

first movable fiction surface means associated with the sheet guide means and having a second coefficient of fiction with said copy sheets which is greater than said first coefficient of friction for selectively impelling said first copy sheet along said copy sheet path;

second movable friction surface means positioned in opposing relationship with said first friction surface means at the sheet guide means and having a third coefficient of friction with said copy sheets which is greater than said first coefficient of friction and less than said second coefficient of fiction, for selectively impelling said second copy sheet along said copy sheet path; and, selectively operable drive means for independently controlling the movement of the first surface means, the drive means including means for stopping movement of said first movable friction surface means to buffer the first copy sheet at said guide means with said trailing edge of said first sheet in said baffle means while said second copy sheet is passed into said guide means between said urging means and said first copy sheet.

24. The buffering apparatus according to claim 23 wherein said urging means comprises a spring member for urging said trailing edge of said first sheet into said baffle means.

25. The buffering apparatus according to claim 23 wherein:

said first movable friction surface means has a second coefficient of friction with said copy sheets which is greater than said first coefficient of friction for selectively impelling said first copy sheet along said copy sheet path; and, said second movable friction surface means has a third coefficient of friction with said copy sheets which is greater than said first coefficient of friction and less than said second coefficient of friction, for selectively impelling said second copy sheet along said copy sheet path.

26. The buffering apparatus according to claim 23 wherein said selectively operable drive means includes means for stopping movement of said second movable friction surface means to buffer the second copy sheet at said guide means with the trailing edge of said second sheet in said baffle means while a third copy sheet is passed into said guide means between said urging means and said second copy sheet.

27. A method of sheet buffering comprising:

defining a sheet travel path with a first paper feeding nip and a second paper feeding nip downstream of said first nip in said sheet travel path;

feeding a trailing edge of a first sheet through said first paper feeding nip and a leading edge of said first sheet into said second paper feeding nip;

moving said trailing edge of said first sheet laterally out of said sheet travel path while said first sheet is held stationary by said second nip; and then, feeding a leading edge of a second sheet through said first paper feeding nip and along said sheet travel path lapping the laterally moved trailing edge of said first sheet to at least partially lap said first and second sheets in said sheet travel path.

28. The method of sheet buffering according to claim 27 wherein the step of defining said sheet travel path includes defining a curvilinear sheet travel path.

29. The method of sheet buffering according to claim 28 wherein:

the step of feeding the trailing edge of the first sheet through said first paper feeding nip and the leading edge of said first sheet into said second paper feeding nip includes the step of bending the first sheet with said curvilinear sheet travel path; and, the step of moving said trailing edge of said first sheet out of said sheet travel path comprises releasing said first sheet from said bending after said trailing edge is released by said first nip and releasing said trailing edge from said sheet travel path.

30. The method of sheet buffering according to claim 29 wherein the step of defining said curvilinear sheet travel path includes the steps of:

defining a first sheet travel path portion tangential to said first paper feeding nip in a first direction by providing said first paper feeding nip in a first orientation; and, defining a second sheet travel path portion tangential to said second paper feeding nip in a second direction by providing said second paper feeding nip in a second orientation different from said first orientation.

31. The method of sheet buffering according to claim 27 wherein the step Of defining said sheet travel path includes providing at least one curved sheet guide member between said first paper feeding nip and said second paper feeding nip defining a curvilinear sheet travel path.

32. The method of sheet buffering according to claim 31 wherein:

the step of receiving the trailing edge of the first sheet through said first paper feeding nip and the leading edge of said first sheet into said second paper feeding nip includes the step of bending the first sheet against said at least one sheet guide member in substantial conformity with said curvilinear sheet travel path; and, the step of moving said trailing edge of said first sheet out of said sheet travel path includes the step of relaxing the trailing edge from said bending into a baffle on said at least one sheet guide member.

33. The method of sheet buffering according to claim 27 wherein the step of defining said sheet travel path includes providing spaced apart guide members between said first paper feeding nip and said second paper feeding nip.

34. The method of sheet buffering according to claim 33 wherein the step of moving said trailing edge of said first sheet out of said sheet travel path includes the step of urging the trailing edge against a first of said spaced apart guide members using a spring member on a second of said spaced apart guide members.

35. A sheet buffering apparatus for use upstream of an operatively associated selectively operable drive member in a sheet transporting system, the apparatus comprising:

a sheet path guide system for defining a predetermined curvilinear course of sheet movement along a sheet path, the guide system including stationary spaced apart curvilinear guide members disposed between a sheet receiving end of the guide system and a sheet dispensing end of the guide system; and, a buffering station formed in a first guide member of said spaced apart guide members for receiving a trailing edge of a first sheet laterally off center of said sheet path while i) a leading portion of the first sheet is held by said selectively operable drive member at the sheet dispensing end of the guide system and ii) a second sheet is received into the sheet receiving end of the guide system along said sheet path lapping said trailing edge of the first sheet.

36. The sheet buffering apparatus according to claim 35 further comprising:

means in said guide system for defining a first sheet travel path portion in a first direction upstream of said buffering station; and, means in said guide system for defining a second sheet travel path portion in a second direction different from said first direction downstream of said buffering station.

37. The sheet buffering apparatus according to claim 35 further including means for urging said trailing edge of said first sheet away from said sheet path.

38. The sheet buffering apparatus according to claim 37 wherein said means for urging the trailing edge of the first sheet away from said sheet path comprises a curved portion of a second guide member of said stationary spaced apart curvilinear guide members.

39. The sheet buffering apparatus according to claim 37 wherein said means for urging the trailing edge of the first sheet away from said sheet path comprises a spring member on a second guide member of said stationary spaced apart curvilinear guide members.

40. The sheet buffering apparatus according to claim 37 wherein said means for urging the trailing edge of the first sheet off said sheet path comprises:

a curved portion of a second guide member of said stationary spaced apart curvilinear guide members; and, a spring member on the curved portion of the second guide member.

41. The sheet buffering apparatus according to claim 35 wherein said buffering station comprises a step formed in said first guide member of said stationary spaced apart curvilinear guide members for positioning said trailing edge of said first sheet laterally entirely off of said sheet path permitting said second sheet to be received along said sheet path avoiding contact with said trailing edge of the first sheet.

42. A method of sheet buffering comprising:

providing at least one pair of stationary spaced apart curvilinear guide members defining a sheet travel path therebetween;

providing a first paper feeding nip downstream of said at least one pair of spaced apart guide members in said sheet travel path;

feeding the leading edge of said first sheet into said first paper feeding nip;

moving the trailing edge of said first sheet laterally out of said sheet travel path; and, urging a leading edge of a second sheet into said pair of spaced apart guide members and along said sheet travel path lapping the trailing edge of said first sheet.

43. The method of sheet buffering according to claim 42 further comprising providing a first guide member of said at least one pair of stationary spaced apart curvilinear guide members with an expanded step portion defining a sheet buffering station receiving said trailing edge of said first sheet moved out of said sheet travel path.

44. The method of sheet buffering according to claim 43 wherein the step of moving the trailing edge of said first sheet out of said sheet travel path includes the step of urging the first sheet into the step portion of the first guide member of said at least one pair of stationary spaced apart curvilinear guide members.

45. The method of sheet buffering according to claim 44 wherein the step of urging the first sheet into the step portion of the first guide member of said at least one pair of stationary spaced apart curvilinear guide members includes urging the first sheet into the step portion with a second guide member of said at least one pair of stationary spaced apart curvilinear guide members.

46. The method of sheet buffering according to claim 44 wherein the step of urging the first sheet includes the step of urging the first sheet into the step portion with a spring member on a second guide member of said at least one pair of stationary spaced apart curvilinear guide members.

47. The method of sheet buffering according to claim 45 wherein the step of urging the leading edge of the second sheet into said at least one pair of stationary spaced apart curvilinear guide members and along said sheet travel path includes the step of feeding the leading edge of the second sheet in between said trailing edge of said first sheet and said second guide member of said at least one pair of stationary spaced apart curvilinear guide members.

48. The method of sheet buffering according to claim 46 wherein the step of urging the leading edge of the second sheet into said at least one pair of stationary spaced apart curvilinear guide members and along said sheet travel path includes the step of feeding the leading edge of the second sheet in between said trailing edge of said first sheet and said second guide member of said at least one pair of stationary spaced apart curvilinear guide members.

* * * * *